United States Patent [19]

Nakaguro

[11] Patent Number: 5,054,549

[45] Date of Patent: Oct. 8, 1991

[54] HEAT EXCHANGER

[75] Inventor: Kazuhiro Nakaguro, Isesaki, Japan

[73] Assignee: Sanden Corporation, Japan

[21] Appl. No.: 487,877

[22] Filed: Mar. 5, 1990

[30] Foreign Application Priority Data

Mar. 6, 1989 [JP] Japan ..... 1-24727[U]

[51] Int. Cl.[5] ..... F28F 19/02

[52] U.S. Cl. ..... 165/133; 165/134.1; 62/498

[58] Field of Search ..... 165/133, 134.1, 180

[56] References Cited

U.S. PATENT DOCUMENTS

| | | | |
|---|---|---|---|
| 4,615,385 | 10/1986 | Saperstein et al. | 165/175 |
| 4,678,112 | 7/1987 | Koisuka et al. | 228/138 |
| 4,831,701 | 5/1989 | Yutaka | 29/157.3 R |
| 4,911,351 | 3/1990 | Ishikawa et al. | 228/183 |

FOREIGN PATENT DOCUMENTS 63-112065 10/1986 Japan .

*Primary Examiner*—Allen J. Flanigan

*Attorney, Agent, or Firm*—Banner, Birch, McKie & Beckett

[57] ABSTRACT

A heat exchanger including a plurality of flat tubes having first and second open ends is disclosed. First and second header pipes are disposed at the first and second open ends of the tubes. The header pipes are constructed of a central tube, and inner and outer brazing layers brazed to the inner and outer surfaces of the central tubes, respectively. The header pipes also include a plurality of slots. The open ends of the tubes are fixedly disposed through the slots such that the interior of each flat tube is in fluid communication with the interior of the header pipes. A plurality of fin units are disposed between the plurality of flat tubes. Each of the plurality of flat tubes is coated with a layer of zinc. The layer of zinc extends throughout the exterior surfaces of the tubes except for first and second uncoated areas disposed adjacent each open end of the tubes. The first and second uncoated areas extend from a location adjacent where the exterior surface of either the outer brazing layer or the central tube contacts the exterior surfaces of the tubes, to the location of the open ends of the tubes.

34 Claims, 7 Drawing Sheets

HEAT EXCHANGER

BACKGROUND OF THE INVENTION

1. Technical Field

The present invention relates to a heat exchanger, and more particularly, to a heat exchanging condenser for use in an automotive air-conditioning system.

2. Description of the Prior Art

With reference to FIG. 1, a conventional refrigeration circuit for use, for example, in an automotive air-conditioning system is shown. Circuit 1 includes compressor 10, condenser 20, receiver or accumulator 30, expansion device 40, and evaporator 50 serially connected through pipe members 60 which link the outlet of one component with the inlet of a successive component. The outlet of evaporator 50 is linked to the inlet of compressor 10 through pipe member 60 so as to complete the circuit. The links of pipe members 60 to each component of circuit 1 are made such that the circuit is hermetically sealed.

In operation of circuit 1, refrigerant gas is drawn from the outlet of evaporator 50 and flows through the inlet of compressor 10, and is compressed and discharged to condenser 20. The compressed refrigerant gas in condenser 20 radiates heat to an external fluid flowing through condenser 20, for example, atmospheric air, and condenses to the liquid state. The liquid refrigerant flows to receiver 30 and is accumulated therein. The refrigerant in receiver 30 flows to expansion device 40, for example, a thermostatic expansion valve, where the pressure of the liquid refrigerant is reduced. The reduced pressure liquid refrigerant flows through evaporator 50, and is vaporized by absorbing heat from a fluid flowing through the evaporator, for example, atmospheric air. The gaseous refrigerant then flows from evaporator 50 back to the inlet of compressor 10 for further compressing and recirculation through circuit 1.

With further reference to FIGS. 2 and 2*a*, conventional heat exchanging condenser 20 is shown. Condenser 20 includes a plurality of adjacent, essentially flat tubes 21 having oval cross section and open ends which allow refrigerant fluid to flow therethrough. Flat tubes 21 may include a plurality of parallel passages. A plurality of corrugated fin units 22 are disposed between adjacent tubes 21. Header pipes 23 and 24 are disposed perpendicularly to flat tubes 21, at each open end. Inlet tube 31 and outlet tube 32 are connected to header pipes 23 and 24 and allow condenser 20 to be linked to the other elements of the circuit by pipe member 60 as shown in FIG. 1.

With further reference to FIG. 3, each header pipe 23 and 24 may have a clad construction and include central tube 26 which may be made from aluminum, and inner and outer metallic tubes or layers 27 and 28 which are brazed to the inner and outer surfaces of central tube 26, respectively. Central tube 26 includes slots 29 disposed therethrough. Flat tubes 21 are fixedly connected to header pipes 23 and 24 and are disposed through slots 29 such that the open ends of flat tubes 21 communicate with the hollow interiors of header pipes 23 and 24. Inner and outer tubes 27 and 28 include brazing portions 27*a* and 28*a* which define openings corresponding to slots 29 in central tube 26. Flat tubes 21 are inserted in slots 29, and portions 27*a* and 28*a* are brazed to the exterior surface of flat tubes 21 near the open ends to ensure that flat tubes 21 are fixedly and hermetically sealed within header pipes 23 and 24.

In operation, compressed refrigerant gas from compressor 10 flows into first header pipe 23 through inlet pipe 31, and is distributed such that a portion of the gas flows through each of flat tubes 21 and into second header pipe 24. As the refrigerant gas flows through flat tubes 21, heat from the refrigerant gas is exchanged with the atmospheric air flowing through corrugated fin units 22 in the direction of arrow W as shown in FIG. 2*a*. Since the refrigerant gas radiates heat to the outside air, it condenses to a liquid mist as it travels through tubes 21. The liquid mist is collected in second header pipe 24, and flows out therefrom through outlet pipe 32 and into receiver 30 where the mist accumulates, and then to the further elements of the circuit as discussed above.

Flat tubes 21, which are generally made of aluminum or an aluminum alloy which comprises substantially aluminum, are subjected to corrosion during normal operation of condenser 20. For example, flat tubes 21 may undergo pitting at many locations on the surface thereof. The pits may eventually develop into openings formed through the surfaces of flat tubes 21, allowing leakage of the refrigerant fluid from condenser 20. Several methods of improving the corrosion resistance of flat tubes 21 are known in the prior art. A first method of improving the corrosion resistance of flat tubes 21 is accomplished by increasing the difference in potential between the materials which make up the flat tubes and the materials which make up the corrugated fin units. That is, the flat tubes are made of materials with a higher potential than the material from which the fin units are made.

The increase in the potential difference may be accomplished by one of two techniques. As an example only, flat tubes 21 may be made of aluminum alloy AA1070, which comprises by weight 0.20% or less Si, 0.25% or less Fe, 0.04% or less Cu, 0.03% Mn, 0.03% or less Mg, 0.04% or less Zn 0.05% or less V, 0.03% or less Ti and the balance substantially aluminum. As shown in FIG. 9, fin units 22 may include core portion 221 comprising AA3003 which comprises by weight 0.6% or less Si, 0.7% or less Fe, 0.05–0.20% Cu, 1.0–1.5% Mn, 0.10% or less Zn, and the balance substantially Al, and inner and outer surface portions 222 and 223 made of AA4045 which comprises by weight, 0.30% or less Cu, 5–13% Si, 0.8% or less Fe, 0.15% or less Mn, 0.1% or less Mg, 0.20% or less Zn, 0.20% or less Ti, and the balance substantially Al. In the first technique, the material from which the corrugated fin units are constructed would be selected so as to decrease the potential as compared to the potential of the material from which flat tubes 21 are constructed. With respect to the present example, the first technique may be accomplished by constructing corrugated fin units 22 out of an aluminum alloy with an increased zinc content, for example, portions 222 and 223 will be made of AA4045 with an additional 1.0% zinc added thereto. Since, corrugated fin units 22 will have an increased proportion of zinc, they will also have a decreased potential as well. Therefore the potential difference between flat tubes 21 and fin units 22 is increased, reducing pitting of the flat tubes.

In the second technique, the material from which flat tubes 21 are constructed would be selected so as to increase the potential as compared to the potential of the material from which fin units 22 are constructed. In the present example, the second technique may be accomplished by constructing flat tubes 21 out of an aluminum alloy with an increased copper content, for example, AA1070 having an increased copper content of 0.35–0.65%. Since flat tubes 21 will have an increased proportion of copper, they will also have an increased potential as well. Therefore the potential difference between flat tubes 21 and fin units 22 is again increased, reducing pitting of the flat tubes.

Although both of the techniques of the above method for constructing the heat exchanger result in a condenser in which flat tubes 21 have increased resistance to corrosion, flat tubes 21 are still prone to undergoing pitting. Eventually, the pitting of flat tubes 21 will result in openings forming through the surfaces of flat tubes 21 and allowing undesirable leakage of the refrigerant from condenser 20 to the outside environment.

A second method of improving the corrosion resistance of flat tubes 21 is accomplished by treating the surfaces of flat tubes 21 such that they are more resistant to pitting. Once again, assuming as an example only that flat tubes 21 are made of AA1070 and fin units 22 are made of a core of AA3003 and outer surface portions of AA4045, flat tubes 21 may be treated according to two techniques. The first technique comprises a galvanizing process in which flat tubes 21 are dipped in a bath of zinc oxide (ZnO) and sodium hydroxide (NaOH). The zinc is diffused through flat tubes 21 due to a displacement reaction. The galvanized flat tubes have increased resistance to pitting. After galvanizing, the overall composition of flat tubes 21 will include 3.0–4.0% Zn. This method is known as disclosed in Japanese Patent Application laid open Gazette No. 56-155,398.

The second technique for treating flat tubes 21 is by zinc spraying. In this technique, zinc wire or powder is fed at a controlled rate into the flame of an oxygas or oxyacetylene torch. The zinc is atomized, and impinges on the external surfaces of the flat tubes to produce a layer of flattened and interlocked particles which are mechanically bonded to the surface being coated. As with galvanizing, the overall composition of flat tubes 21 will include 3.0–4.0% Zn. Once again, this process offers increased resistance to pitting.

However, even though both galvanizing and zinc spraying offer increased resistance to pitting, the flat tubes treated in this manner are more likely to undergo corrosion due to stratiform corrosion, that is, corrosion which occurs in even layers, than non-treated flat tubes. Since stratiform corrosion is a slower process in which a whole layer of the flat tube corrodes simultaneously, it takes longer for openings to form through the surface of flat tubes 21 than when flat tubes 21 are more susceptible to pitting as in the first method. Thus, by using the second method, the usable lifetime of flat tubes 21 is increased as compared to the situation in which the flat tube is untreated or is treated by the first method. In practice, since better overall corrosion resistance is provided by the second method in which the form of corrosion that the flat tubes are likely to undergo is changed from pitting to stratiforming, this method is preferred and used more frequently than the first method.

However, even in a heat exchanger in which the second method is utilized and pitting is prevented, undesirable leakage of refrigerant fluid from the condenser still occurs. Specifically, as shown in FIG. 4, in the second prior art method, the entire exterior surfaces of flat tubes 21 are covered by zinc layer 210. Therefore, zinc layer 210 extends through slots 29 of header pipes 23 and 24 such that brazing portions 27*a* and 28*a* are brazed to the header pipes at zinc layers 210. The left side of the figure shows a flat tube including a zinc layer which has not undergone stratiform corrosion, and thus, the condenser is effectively hermetically sealed at the location where brazing portions 27*a* and 28*a* are brazed to flat tubes 21. However, as shown in the right side of the figure, after continued operation of condenser 20, the stratiform corrosion of the surface of flat tubes 21 will extend into the area where portions 27*a* and 28*a* are brazed to flat tubes 21, thereby decreasing the effective hermetic sealing of the condenser. As shown in the figure in exaggerated detail for clarity, stratiforming of flat tubes 21 results in gaps G forming between the surfaces of tubes 21 and brazing portions 27*a* and 28*a* and central tube 26. These gaps allows the refrigerant fluid to leak from header pipes 23 and 24 to the exterior region of heat exchanger 20.

SUMMARY OF THE INVENTION

The invention is directed to a heat exchanger including a plurality of tubes having first and second open ends. First and second header pipes are disposed at the first and second open ends, respectively, of the tubes. The header pipes have a plurality of slots, and the open ends of the tubes are fixedly disposed through the slots such that the interior of each tube is in fluid communication with the interior of the pipes. A plurality of fin units are disposed between the plurality of tubes. Each of the plurality of tubes is coated with a layer of zinc. The layer of zinc extends throughout the exterior surfaces of the tubes except for first and second uncoated areas disposed adjacent each open end of the tubes.

In a further embodiment, the first and second uncoated areas extend from at least a location adjacent the exterior surface of the first and second header pipes at the slots, to the location of the open ends of the tubes.

In a further embodiment, the tubes comprise essentially flat tubes made of aluminum or an aluminum alloy.

In a further embodiment, the first and second header pipes each comprise a central tube, and inner and outer brazing layers brazed to the inner and outer surfaces of the central tube, respectively. Furthermore, the uncoated areas extend at least from where the exterior surface of either the outer brazing layer or the central tube contacts the exterior surfaces of the tubes.

In a further embodiment the heat exchanger includes a serpentined tube having first and second open ends and a plurality of parallel portions spaced apart from each other. The open ends of the serpentined tube are fixedly disposed through the slots such that the interior of the serpentined tube is in fluid communication with the interior of the header pipes.

In a further embodiment, the heat exchanger forms part of a refrigerant fluid circuit including a compressor, the heat exchanger, an accumulator, an expansion device and an evaporator sequentially disposed.

In a further embodiment, the invention is directed to a method of forming the exchanger and the circuit including the exchanger.

By the present invention, the heat exchanger made of aluminum or an aluminum alloy may be constructed having a high durability and an increased resistance to corrosion. Furthermore, such a heat exchanger decreases the likelihood of refrigerant fluid leaking to the exterior thereof.

Further advantages, features and other aspects of this invention will be understood from the following detailed description of the preferred embodiment of this invention with reference to the drawings.

DETAILED DESCRIPTION OF THE PREFERRED EMBODIMENTS

Figure 1:
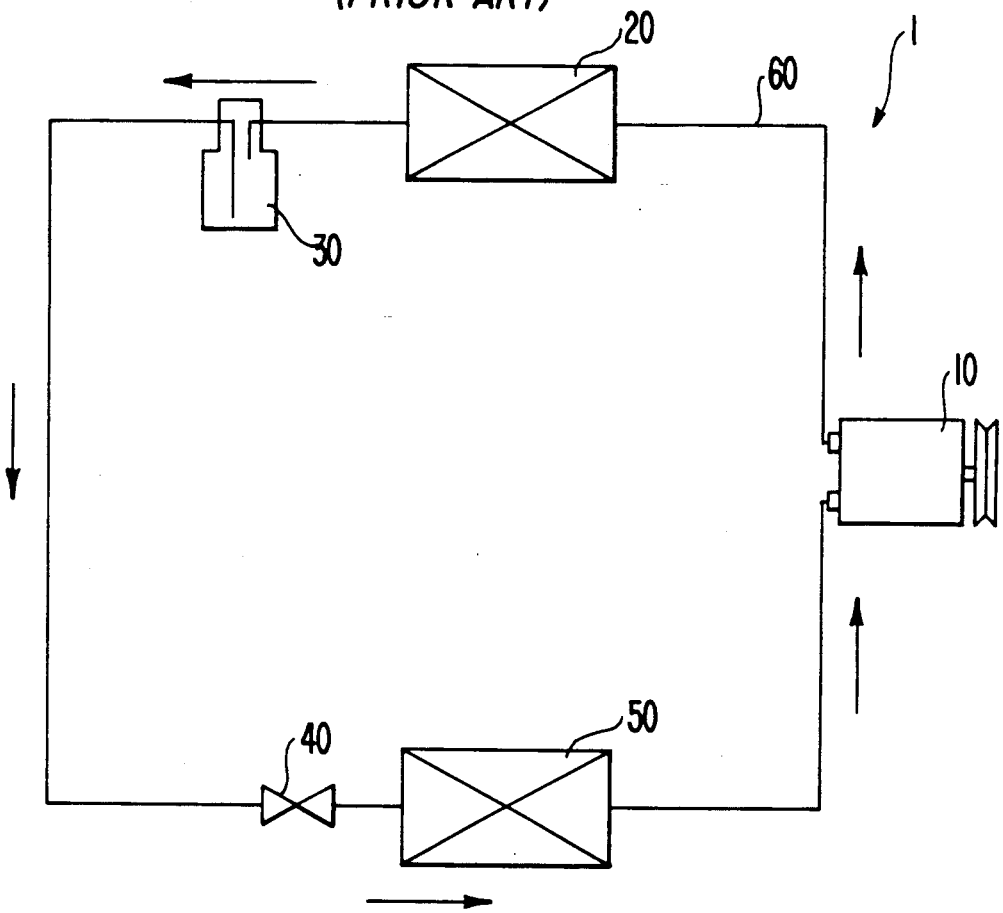
FIG. 1 (PRIOR ART)
FIG. 1 is a schematic block diagram of a refrigerant fluid circuit in accordance with the prior art.
Figure 2:
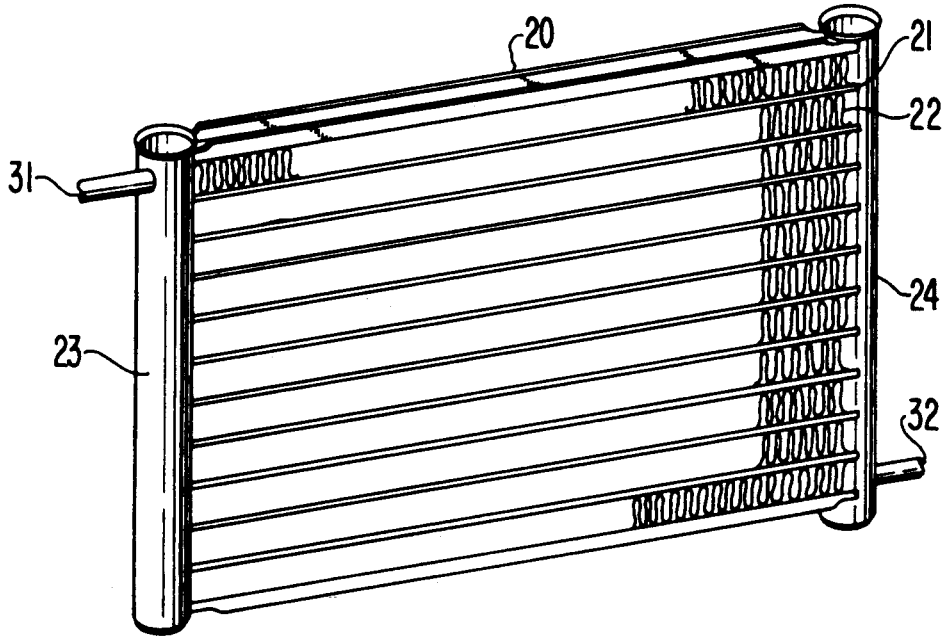
FIG. 2 (PRIOR ART)
FIG. 2 is elevational view of the condenser shown in the refrigerant circuit of FIG. 1.
Figure 2A:
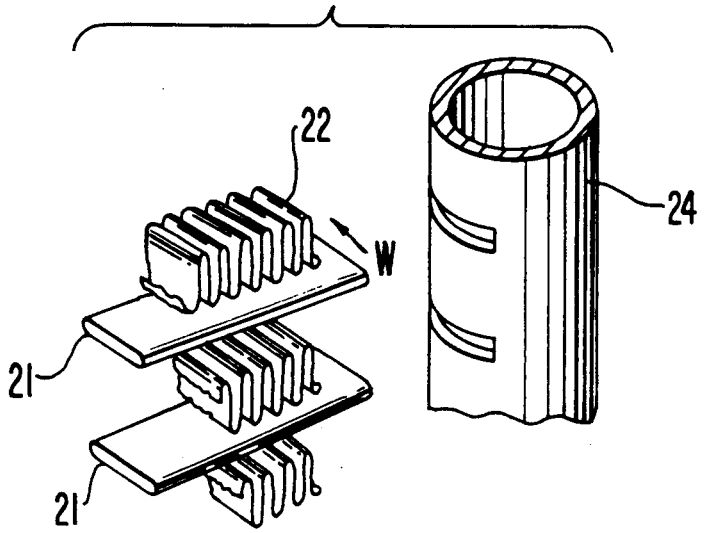
FIG. 2a (PRIOR ART)
FIG. 2*a* is a perspective view of certain elements of the condenser shown in FIG. 2.
Figure 3:
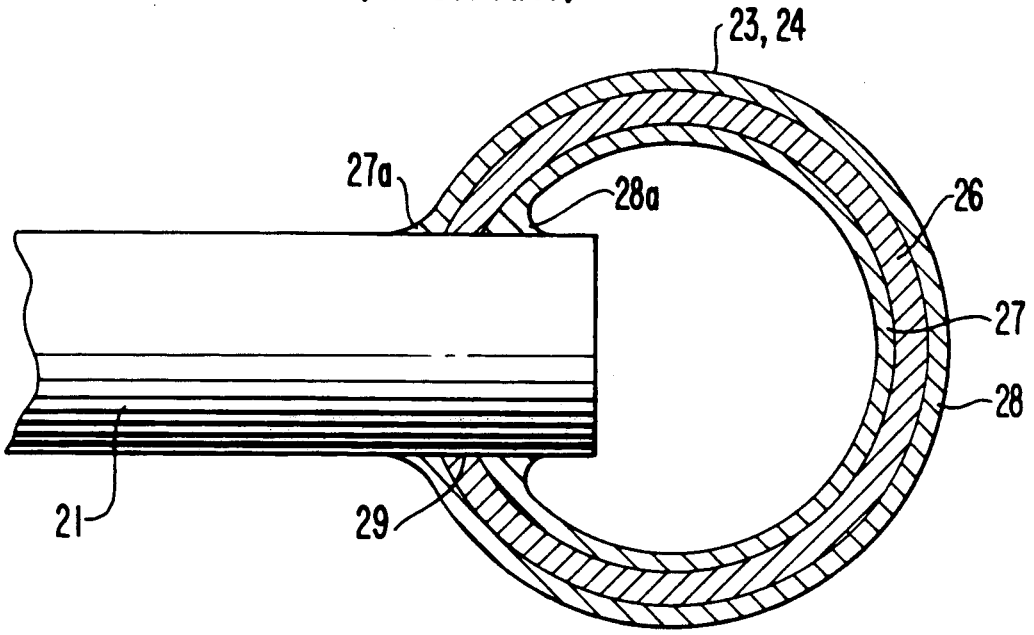
FIG. 3 (PRIOR ART)
FIG. 3 is a partial cross-sectional view of a header pipe and a flat tube forming part of the condenser shown in FIG. 2.
Figure 4:
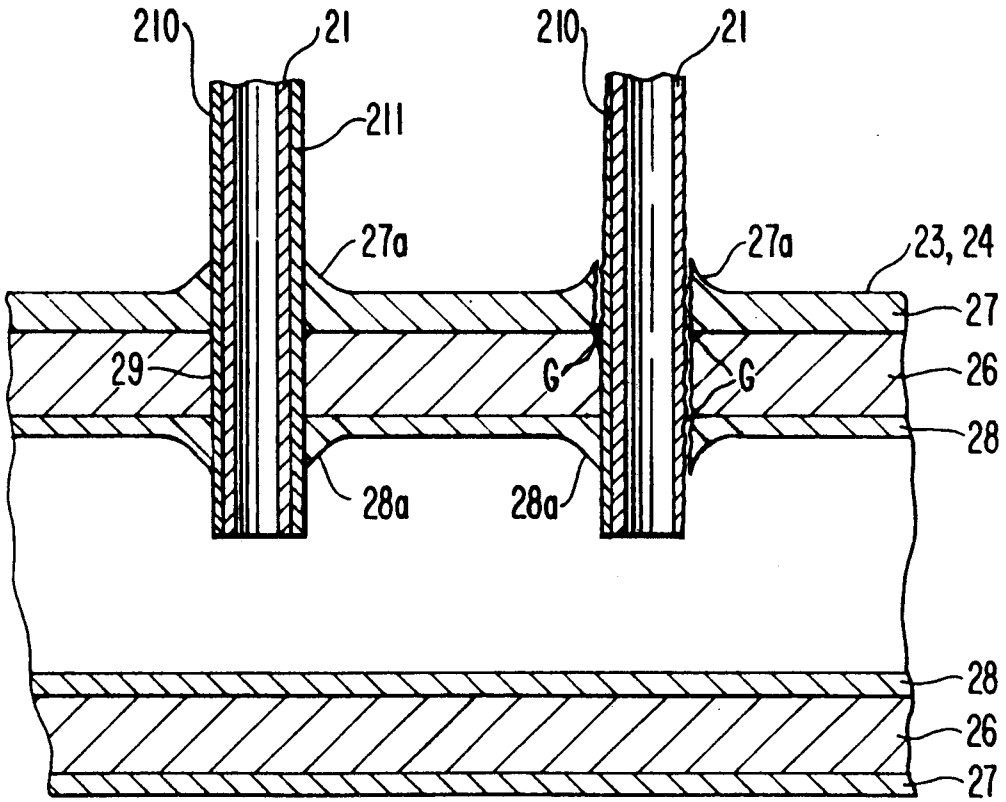
FIG. 4 (PRIOR ART)
FIG. 4 is a partial enlarged cross-sectional view showing the connecting region of the flat tube and header pipe of the condenser shown in FIG. 2.
Figure 5:
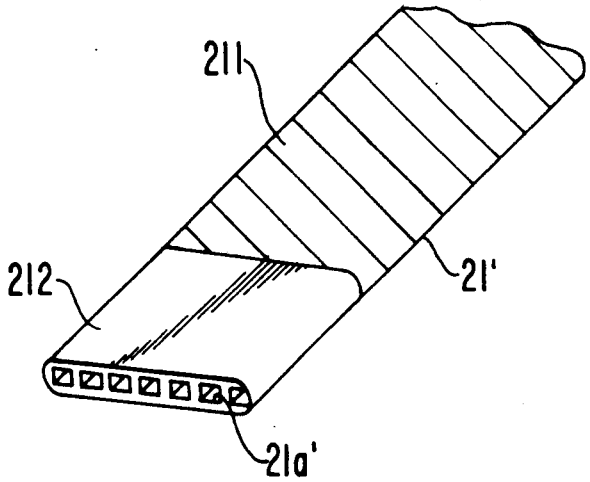
FIG. 5 is a perspective view of a flat tube in accordance with the present invention.
Figure 6:
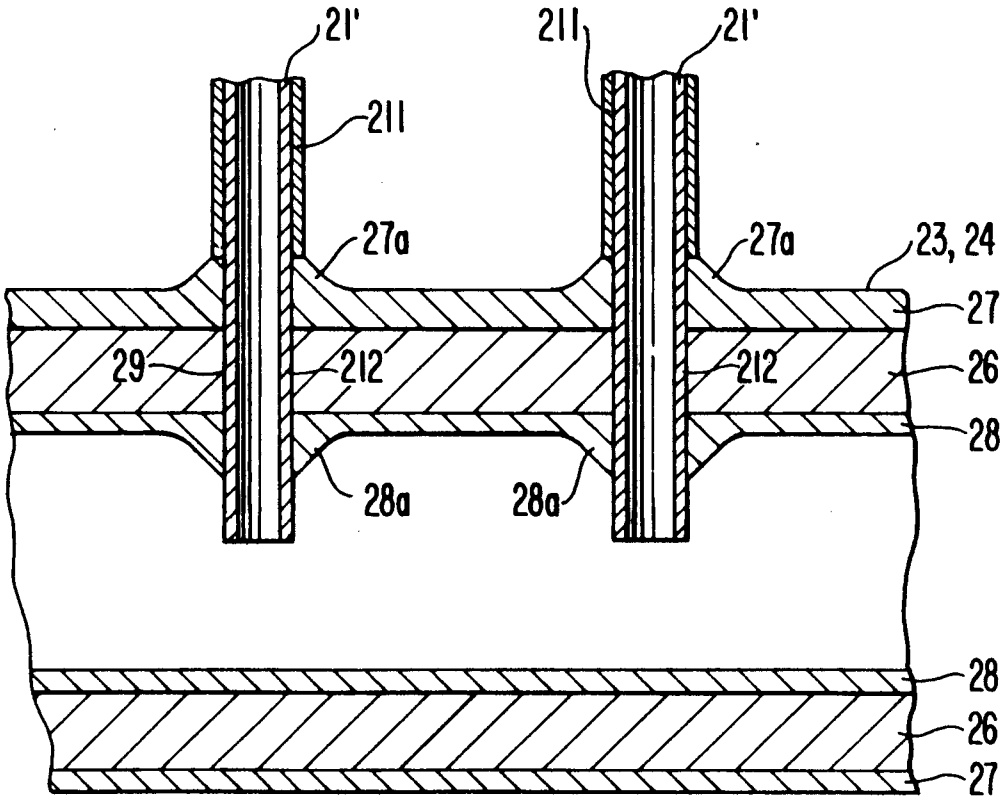
FIG. 6 is a partial enlarged cross-sectional view showing the connecting region between the flat tube and the header pipe for a condenser in accordance with one embodiment of this invention.

With reference to FIGS. 5 and 6, a portion of a heat exchanger in accordance with a first embodiment of the invention is shown. Additionally, the overall shape of the condenser is similar to condenser 20 shown in FIGS. 2–4 and the same reference numerals are used to denote corresponding elements, with primed reference numerals used for elements having similar structure. Therefore, a complete explanation of these elements is omitted.

As shown in FIG. 5, flat tubes 21' may include a plurality of parallel passageways 21*a'* formed therein and extending in the longitudinal direction. Flat tubes 21' may be made of aluminum or an aluminum alloy, for example, AA1070. Zinc layer 211 is coated on flat tube 21' by either of the prior art methods, that is, galvanizing or zinc spraying. However, in the present invention, only a portion of the exterior surface of flat tubes 21' is coated with zinc such that zinc layer 211 is not coated on flat tube 21' at both end portions 212. Although only one uncoated end portion 212 is shown, flat tube 21' may have two uncoated end portions at opposite ends. As in the prior art, flat tubes 21' are subjected to stratiform corrosion at the surfaces thereof which are coated by zinc layer 211.

As shown in FIG. 6, end portions 212 are inserted into the interior of header pipes 23 and 24 through slots 29 formed therethrough. Brazing portions 27*a* and 28*a* of inner and outer tubes or layers 27 and 28 are brazed onto flat tubes 21' at uncoated end portions 212. Thus, zinc layers 211 terminate approximately at the outermost surface of brazing layers 27*a* of header pipes 23 and 24. Accordingly, even if flat tube 21' is subjected to stratiform corrosion throughout the area thereof which is covered by zinc layer 211, the extent of the stratiform corrosion terminates at the outermost surface of brazing portions 27*a*. Thus, the surfaces of flat tubes 21' onto which the brazing portions are brazed is not subjected to stratiform corrosion as in the prior art. Therefore, since in the present invention flat tubes 21' are not subjected to stratiform corrosion at the end portions thereof which are inserted in header pipes 23 and 24, condenser 20 will not develop gaps at the locations where flat tubes 21 are hermetically sealed in the header pipes by brazing portions 27*a* and 28*a*, and leakage of refrigerant fluid from header pipes 23 and 24 to the exterior of the exchanger is prevented.

Figure 7:
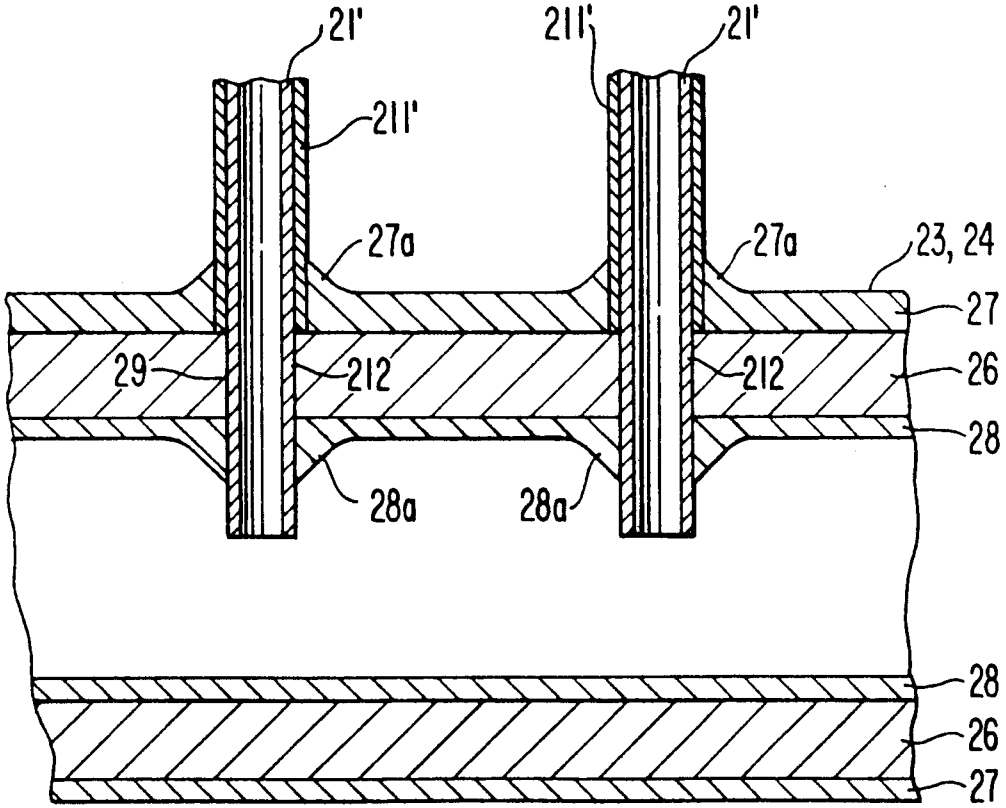
FIG. 7 is a partial enlarged cross-sectional view showing a connecting region between the flat tube and the header pipe of a condenser in accordance with a second embodiment of this invention.

With reference to FIG. 7, a second embodiment of the present invention is shown. In the embodiment of FIG. 7, zinc layer 211' extends approximately to the innermost surface of brazing portion 27*a*, that is, approximately to the outermost surface of slots 29 of central tube 26. Accordingly, even if flat tube 21' is subjected to stratiform corrosion throughout the area thereof which is covered by zinc layer 211', the extent of the stratiform corrosion terminates at the outermost surface of central tube 26. Therefore, even if gapping occurs between flat tube 21' and brazing portions 27*a* due to stratiform corrosion, since the stratiform corrosion does not extend beyond the outer surface of central tube 26, no gaps will form between flat tubes 21' and the header pipes at the location of central tubes 26 or brazing portions 28*a*. Therefore, as in the first embodiment of the present invention, leakage of refrigerant fluid from header pipes 23 and 24 to the exterior of the exchanger is prevented.

Figure 8:
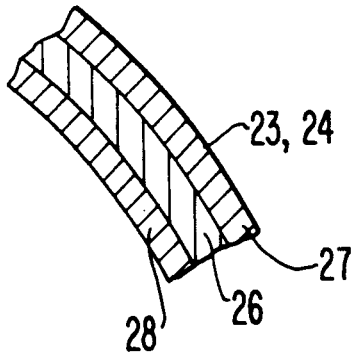
FIG. 8 is a partial enlarged cross-sectional view showing a header pipe which may be used in both the prior art and the present invention.

With reference to FIG. 8, a cross-sectional view of header pipes 23 and 24 which may be used in both the prior art and the present invention is shown. As an example only, central tube 26 may be made of AA3003 which comprises by weight, 0.6% or less Si, 0.7% or less Fe, 0.05–0.20% Cu, 1.0–1.5% Mn, 0.10% or less Zn, and the balance substantially Al. Inner and outer layers 27 and 28 may be made of, for example, AA4045 which comprises by weight, 0.30% or less Cu, 5–13% Si, 0.8% or less Mn, 0–0.1% Mg, 0.20% or less Zn, 0–0.20% Ti, and the balance substantially Al.

Figure 9:
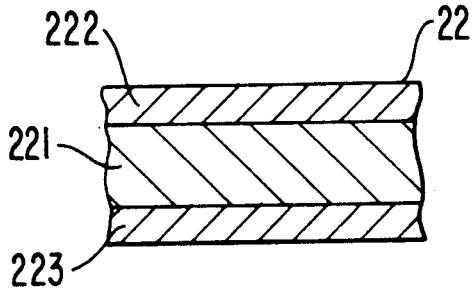
FIG. 9 is a partial enlarged cross-sectional view of a corrugated fin unit which may be used in both the prior art and the present invention.

With further reference to FIG. 9, a cross-sectional view of corrugated fin unit 22 which may be used in both the prior art and the present invention is shown. As an example only, fin units 22 may include core layer 221 made of AA3003, and cladding layers 222 and 223 which are disposed on both outer surfaces of layer 221. Both layers 222 and 223 may be made of an aluminum alloy brazing metal which comprises by weight, 0.30% or less Cu, 5–13% Si, 0.8% or less Fe, 0.15% or less Mn, 0–0.1% Mg, 1.20% or less Zn, 0–0.2% Ti, and the balance substantially Al. This composition for layers 222 and 223 corresponds to AA4045 with the addition of 1.0% Zn.

Figure 10:
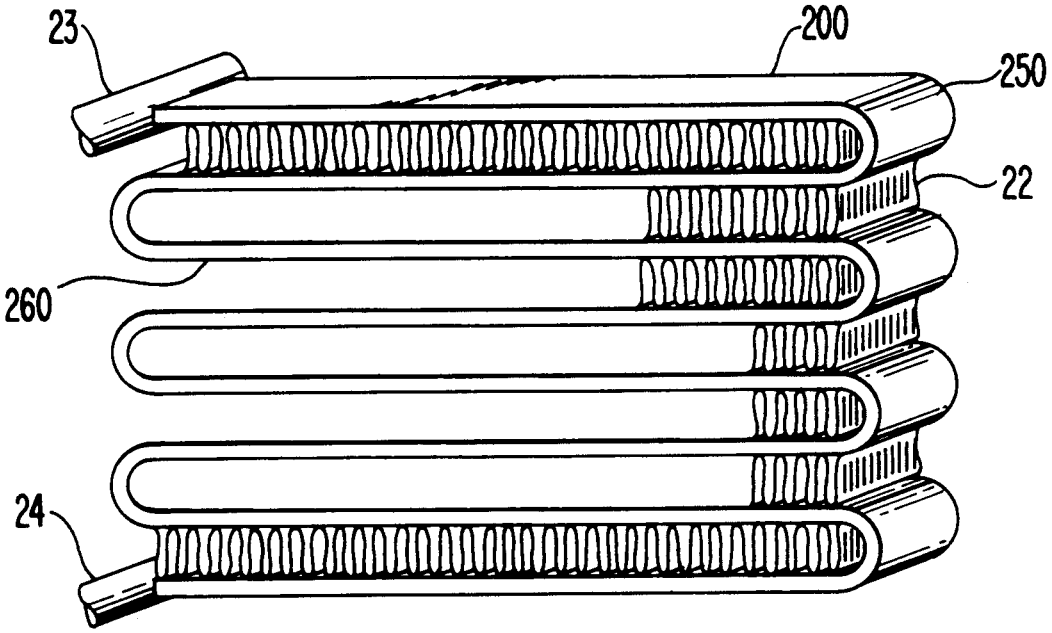
FIG. 10 is a perspective view of a serpentine type aluminum heat exchanger which includes the improvement of the present invention.

With reference to FIG. 10 a serpentined-type heat exchanger 200 with which the present invention may be used is shown. The overall structure of exchanger 200 is known in the prior art. Exchanger 200 includes serpentined tube 250 having a serpentined-anfractuous shape in its longitudinal extending direction. Therefore, tube 250 includes a plurality of parallel spaced 260 portions and a plurality of fin units 22 may be disposed between parallel portions 260. Header pipes 23 and 24 are disposed at the open ends of tube 250. Serpentined tube 250 is coated with a zinc layer as shown with respect to flat tubes 21' in FIG. 5 such that the end portions of tube 250 which are disposed in header pipes 23 and 24 and to which brazing portions 27*a* and 28*a* are brazed, are not coated with zinc. Therefore, undesirable gapping due to stratiforming is avoided.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the appended claims.

I claim:

1. In a heat exchanger comprising a plurality of tubes having first and second open ends, first and second header pipes disposed at said first and second open ends, respectively, said first and second header pipes having a plurality of slots formed therein, said open ends of said tubes fixedly disposed through said slots such that the interior of each said tube is in fluid communication with the interior of said first and second header pipes, and a plurality of fin units disposed between said plurality of tubes, the improvement comprising:

each of said plurality of tubes coated with a layer of zinc, said layer of zinc extending throughout the exterior surfaces of said tubes except for first and second uncoated areas disposed adjacent each open end of said tubes.

2. The heat exchanger recited in claim 1, said first and second uncoated areas extending from at least a location adjacent the exterior surface of said first and second header pipes at said slots to locations adjacent said open ends of said tubes.

3. The heat exchanger recited in claim 2, said tubes comprising essentially flat tubes made of aluminum or an aluminum alloy.

4. The heat exchanger recited in claim 3, said flat tubes made of AA1070.

5. The heat exchanger recited in claim 1, said first and second header pipes comprising a central tube, and inner and outer brazing layers brazed to the inner and outer surfaces of said central tube, respectively, said first and second uncoated areas extending from at least a location where the exterior surface of said outer brazing layer contacts the exterior surfaces of said plurality of tubes to locations adjacent said open ends of said plurality of tubes.

6. The heat exchanger recited in claim 5, said central tube comprising aluminum or an aluminum alloy, and said inner and outer brazing layers comprising aluminum alloys.

7. The heat exchanger recited in claim 6, said central tube comprising AA3003 and said inner and outer brazing layers comprising AA4045.

8. The heat exchanger recited in claim 1, said first and second header pipes comprising a central tube, and inner and outer brazing layers brazed to the inner and outer surfaces of said central tube, respectively, said first and second uncoated areas extending from at least a location where the exterior surface of said central tube contacts the exterior surfaces of said plurality of tubes to locations adjacent said open ends of said plurality of tubes.

9. The heat exchanger recited in claim 8, said central tube comprising aluminum or an aluminum alloy, and said inner and outer brazing layers comprising aluminum alloys.

10. The heat exchanger recited in claim 9, said central tube comprising AA3003 and said inner and outer brazing layers comprising AA4045.

11. In a refrigerant fluid circuit comprising a compressor, a heat exchanger, an accumulator, an expansion device and an evaporator sequentially disposed, said heat exchanger comprising a plurality of tubes having first and second open ends, first and second header pipes disposed at said first and second open ends, respectively, said first and second header pipes having a plurality of slots formed therein, said open ends of said tubes fixedly disposed through said slots such that the interior of each said tube is in fluid communication with the interior of said first and second header pipes, and a plurality of fin units disposed between said plurality of tubes, the improvement comprising:

each of said plurality of tubes coated with a layer of zinc, said layer of zinc extending throughout the exterior surfaces of said tubes except for first and second uncoated areas disposed adjacent each open end of said tubes.

12. The circuit recited in claim 11, said first and second uncoated areas extending from at least a location adjacent the exterior surface of said first and second header pipes at said slots to locations adjacent said open ends of said tubes.

13. The refrigerant fluid circuit recited in claim 12, said tubes comprising essentially flat tubes made of aluminum or an aluminum alloy.

14. The refrigerant fluid circuit recited in claim 13, said flat tubes made of AA1070.

15. The refrigerant fluid circuit recited in claim 11, said first and second header pipes comprising a central tube, and inner and outer brazing layers brazed to the inner and outer surfaces of said central tube, respectively, said first and second uncoated areas extending from at least a location where the exterior surface of said outer brazing layer contacts the exterior surfaces of said plurality of tubes to locations adjacent said open ends of said plurality of tubes.

16. The refrigerant fluid circuit recited in claim 15, said central tube comprising aluminum or an aluminum alloy, and said inner and outer brazing layers comprising aluminum alloys.

17. The refrigerant fluid circuit recited in claim 16, said central tube comprising AA3003 and said inner and outer brazing layers comprising AA4045.

18. The refrigerant fluid circuit recited in claim 11, said first and second header pipes comprising a central tube, and inner and outer brazing layers brazed to the inner and outer surfaces of said central tube, respectively, said first and second uncoated areas extending from at least a location where the exterior surface of said central tube contacts the exterior surfaces of said plurality of tubes to locations adjacent said open ends of said plurality of tubes.

19. The refrigerant fluid circuit recited in claim 18, said central tube comprising aluminum or an aluminum alloy, and said inner and outer brazing layers comprising aluminum alloys.

20. The refrigerant fluid circuit recited in claim 19, said central tube comprising AA3003 and said inner and outer brazing layers comprising AA4045.

21. In a heat exchanger comprising a serpentined tube having first and second open ends and a plurality of parallel portions spaced apart from each other, first and second header pipes disposed at said first and second open ends, respectively, said first and second header pipes having a slot formed therein, said open ends of said serpentined tube fixedly disposed through said slots such that the interior of said serpentined tube is in fluid communication with the interior of said first and second header pipes, and a plurality of fin units disposed between said plurality of parallel portions, the improvement comprising:

said serpentined tube coated with a layer of zinc, said layer of zinc extending throughout the exterior surfaces of said serpentined tube except for first and second uncoated areas disposed adjacent each open end of said serpentined tube.

22. The heat exchanger recited in claim 21, said first and second uncoated areas extending from at least a location adjacent the exterior surface of said first and second header pipes at said slots to locations adjacent said open ends of said serpentined tube.

23. The heat exchanger recited in claim 22, said serpentined tube comprising aluminum or an aluminum alloy.

24. The heat exchanger recited in claim 21, said first and second header pipes comprising a central tube, and inner and outer brazing layers brazed to the inner and outer surfaces of said first and second header pipes, respectively, said first and second uncoated areas extending from at least a location where the exterior surface of said outer brazing layer contacts the exterior surfaces of said serpentined tube to locations adjacent said open ends of said serpentined tube.

25. The heat exchanger recited in claim 24, said central tube comprising aluminum or an aluminum alloy, and said inner and outer brazing layers comprising aluminum alloys.

26. The heat exchanger recited in claim 21, said first and second header pipes comprising a central tube, and inner and outer brazing layers brazed to the inner and outer surfaces of said first and second header pipes, respectively, said first and second uncoated areas extending from at least a location where the exterior surface of said central tube contacts the exterior surfaces of said serpentined tube to locations adjacent said open ends of said serpentined tube.

27. The heat exchanger recited in claim 26, said central tube comprising aluminum or an aluminum alloy, and said inner and outer brazing layers comprising aluminum alloys.

28. In a refrigerant fluid circuit comprising a compressor, a heat exchanger, an accumulator, an expansion device and an evaporator sequentially disposed, said heat exchanger comprising a serpentined tube having first and second open ends and a plurality of parallel portions spaced apart from each other, first and second header pipes disposed at said first and second open ends, respectively, said first and second header pipes having a slot formed therein, said open ends of said serpentined tube fixedly disposed through said slots such that the interior of said serpentined tube is in fluid communication with the interior of said first and second header pipes, and a plurality of fin units disposed between said plurality of parallel portions, the improvement comprising:

said serpentined tube coated with a layer of zinc, said layer of zinc extending throughout the exterior surfaces of said serpentined tube except for first and second uncoated areas disposed adjacent each open end of said serpentined tube.

29. The circuit recited in claim 28, said said first and second uncoated areas extending from at least a location adjacent the exterior surface of said first and second header pipes at said slots to locations adjacent said open ends of said serpentined tube.

30. The circuit recited in claim 29, said serpentined tube comprising aluminum or an aluminum alloy.

31. The circuit recited in claim 28, said first and second header pipes comprising a central tube, and inner and outer brazing layers brazed to the inner and outer surfaces of said central tube, respectively, said first and second uncoated areas extending from at least a location where the exterior surface of said outer brazing layer contacts the exterior surfaces of said serpentined tube to locations adjacent said open ends of said serpentined tube.

32. The circuit recited in claim 31, said central tube comprising aluminum or an aluminum alloy, and said inner and outer brazing layers comprising aluminum alloys.

33. The circuit recited in claim 28, said first and second header pipes comprising a central tube, and inner and outer brazing layers brazed to the inner and outer surfaces of said central tube, respectively, said first and second uncoated areas extending from at least a location where the exterior surface of said central tube contacts the exterior surfaces of said serpentined tube to locations adjacent said open ends of said serpentined tube.

34. The circuit recited in claim 33, said central tube comprising aluminum or an aluminum alloy, and said inner and outer brazing layers comprising aluminum alloys.

* * * * *